US008419155B2

(12) United States Patent
Kawakami et al.

(10) Patent No.: US 8,419,155 B2
(45) Date of Patent: Apr. 16, 2013

(54) PRINTING APPARATUS

(75) Inventors: Kazuhisa Kawakami, Yokohama (JP); Kenji Shigeno, Yokohama (JP); Noriyuki Aoki, Tokyo (JP); Yuji Kanome, Yokohama (JP); Kosuke Yamamoto, Yokohama (JP); Masakazu Tsukuda, Tokyo (JP); Haruo Uchida, Yokohama (JP); Hiroyuki Saito, Yokohama (JP); Yoshiaki Suzuki, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 642 days.

(21) Appl. No.: 12/619,074

(22) Filed: Nov. 16, 2009

(65) Prior Publication Data

US 2010/0134551 A1 Jun. 3, 2010

(30) Foreign Application Priority Data

Dec. 2, 2008 (JP) ..... 2008-307720

(51) Int. Cl.
*B41J 29/38* (2006.01)

(52) U.S. Cl.
USPC ..... 347/16; 347/14

(58) Field of Classification Search ..... 347/16
See application file for complete search history.

(56) References Cited

U.S. PATENT DOCUMENTS

| | | | | |
|---|---|---|---|---|
| 4,328,504 | A * | 5/1982 | Weber et al. | 347/14 |
| 5,998,956 | A | 12/1999 | Saito | |
| 6,890,047 | B2 * | 5/2005 | Fujibayashi et al. | 347/12 |
| 7,040,733 | B2 * | 5/2006 | Hin | 347/19 |
| 7,083,245 | B2 | 8/2006 | Yamamoto | |
| 7,104,710 | B2 | 9/2006 | Otsuka | 400/76 |
| 7,192,112 | B2 | 3/2007 | Nakanishi et al. | |
| 7,192,114 | B2 | 3/2007 | Suzuki et al. | |
| 7,506,947 | B2 | 3/2009 | Uchida | |
| 7,883,202 | B2 * | 2/2011 | Yoshida | 347/104 |
| 2005/0083361 | A1 | 4/2005 | Nakanishi et al. | |
| 2006/0132524 | A1 * | 6/2006 | Ikegame | 347/16 |
| 2007/0132805 | A1 | 6/2007 | Nakanishi et al. | |
| 2010/0201733 | A1 * | 8/2010 | Yoshida et al. | 347/16 |
| 2010/0271414 | A1 * | 10/2010 | Kaizu et al. | 347/16 |

FOREIGN PATENT DOCUMENTS

| | | | |
|---|---|---|---|
| JP | 56-81414 | * | 7/1981 |
| JP | 60-257279 | * | 12/1985 |

* cited by examiner

*Primary Examiner* — Charlie Peng
(74) *Attorney, Agent, or Firm* — Fitzpatrick, Cella, Harper & Scinto

(57) ABSTRACT

A printing apparatus includes a plurality of image sensors imaging a sheet to be conveyed, and a direct sensor unit performing the signal processing of the outputs of the image sensors to detect the movement of the sheet. Here, the plurality of image sensors are provided on the carriage at least at two positions with at least the recording element array diagonally put between the two positions. The plurality of image sensors can image the sheet at two positions separated in a main scan direction and a sub-scan direction.

8 Claims, 9 Drawing Sheets

PRINTING APPARATUS

BACKGROUND OF THE INVENTION

1. Field of the Invention

The present invention relates to a printing apparatus, for example to an ink jet printing apparatus which prints by discharging a liquid such as ink.

2. Description of the Related Art

In ink jet printing apparatuses, to realize a high-quality image, a high conveyance accuracy of a sheet-like printing media (in the present specification, simply referred to as a "sheet") is required. Recently, to control conveyance with a higher degree of accuracy, direct sensors are being realized which directly detect a movement amount of the sheet by imaging the sheet surface and then performing image processing. For example, U.S. Pat. No. 7,104,710 discusses a technique for controlling conveyance by using a direct sensor. In the apparatus discussed in that document, the direct sensor is provided on a carriage which mounts a print head, or at a position facing a discharge port face of the print head.

However, in this configuration the sheet can only be imaged at a position where the direct sensor is fixed in the sheet conveyance direction. Therefore, during sheet conveyance, the sheet may not be present at a sensing position of the direct sensor in a certain period (hereinafter, referred to as "sensing disabled period"). For example, in a case where an image is printed by a multipass method during printing on a trailing edge or a leading edge of the sheet, if the sheet edge portion deviates from the sensing position during printing, thereby making sensing impossible, conveyance cannot be controlled with a high degree of accuracy. As a result, there is the problem that the quality of that portion cannot be guaranteed.

In addition, in this configuration, if the direct sensor provided on the carriage is single, it is difficult to obtain a detection region exceeding the movable stroke of the reciprocating carriage, and there is the possibility of being impossible of covering the maximum sheet width. If the direct sensor is provided to be offset to the side of one end (e.g. reference side) of the moving direction on the carriage, the very end of the sheet can be read when the carriage moves to the side of the end. However, when the carriage moves to the other end (non-reference side), it is impossible to read the very end of the sheet with the direct sensor.

SUMMARY OF THE INVENTION

The present invention is directed to a printing apparatus. More specifically, the present invention is directed to a printing apparatus which can reduce the sensing disabled period of the direct sensor.

According to an aspect of the present invention, a printing apparatus, comprising: a conveying mechanism which moves a sheet in a sub-scan direction; a printing unit which performs printing on the sheet, the printing unit holding a print head in which a recording element array is formed, the printing unit including a carriage reciprocating along a main scan direction intersecting the sub-scan direction; and a direct sensor unit including a plurality of image sensors for imaging the sheet, the direct sensor unit performing signal processing of outputs of the image sensors to detect a movement of the sheet, wherein the plurality of image sensors are provided on the carriage at least at two positions with at least the recording element array diagonally put between the two positions.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
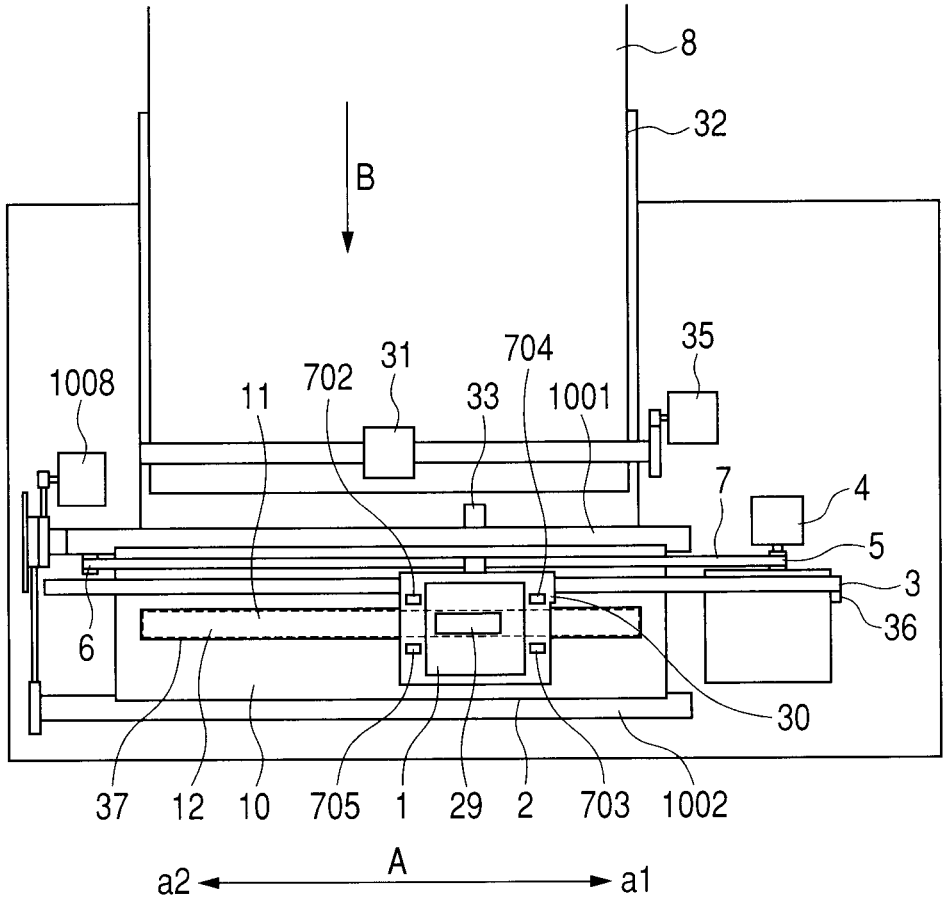
FIG. 1 is a plan view illustrating an ink jet printing apparatus.

FIG. 1 is a plan view illustrating the configuration of the principal part of a printing apparatus to which the present invention can be applied.

As illustrated in FIG. 1, a head cartridge 1 is removably mounted on a carriage 2. The head cartridge 1 includes a print head equipped with an ink jet system nozzle array 29 (recording element array), and an ink tank unit for supplementing ink to each printing element. Incidentally, the present invention is not limited to the ink jet system, but can be applied to various printing apparatuses, such as a thermal printer having a recording head equipped with a thermal sublimation type recording element array or a transfer type recording element array, and a dot-impact printer having a recording head equipped with a dot-impact system recording element array.

Furthermore, the head cartridge 1 is provided with a connector for giving and receiving a signal for driving the print head, and the like. The carriage 2 is provided with a connector holder for transmitting a drive signal and the like to the head cartridge 1 through the connector.

The apparatus main body of the ink jet printing apparatus is provided with a guide shaft 3. The carriage 2 is supported to be guided by the guide shaft 3, and is adapted to be able to reciprocate along the axial direction of the guide shaft 3 in the scan direction (main scan direction), which is the direction of an arrow A in FIG. 1. The right side of the drawing, which is one end side of the main scan direction, is called a reference side a1, and the left side of the drawing, which is the other end side in the main scan direction, is called a non-reference side a2. The movement of the carriage 2 is performed by a main scan motor 4 through a drive mechanism including a motor pulley 5, a driven pulley 6, a timing belt 7, and the like.

Moreover, although it is not illustrated, the positional information of the carriage 2 is obtained with a rotation angle sensor and a code strip, both provided on the carriage 2, and the position and the conveyance amount of the carriage 2 are controlled.

Furthermore, the carriage 2 is provided with a home position sensor 30. The home position sensor 30 is adapted to enable the detection of the presence of the carriage 2 at the home position thereof by the passage of the home position sensor 30 over a shielding plate 36 at the home position.

A sheet 8, such as a sheet of print paper and a plastic thin plate, as the sheet, is loaded on an auto sheet feeder (ASF) 32 to be held thereon before the performance of a printing operation. When the printing operation is started, a feed motor 35 is driven, and the driving force thereof is transmitted to a pickup roller 31 through a gear. Thereby, the pickup roller 31 is rotated, and the sheet 8 is separated from the auto sheet feeder 32 sheet by sheet to be conveyed to a printing unit 37.

Successively, the sheet 8 is conveyed into a conveyance direction (sub-scan direction), which is the direction of an arrow B, at a predetermined conveyance speed as a conveyance roller 1001 rotates, and passes the position opposed to the nozzle array 29 of the head cartridge 1. In the sub-scan direction, the upper side of the nozzle array 29 is called an upstream side, and the lower side of the nozzle array 29 is called a downstream side. Moreover, the main scan direction and the sub-scan direction intersect each other (crossing at right angles).

Figure 4A:
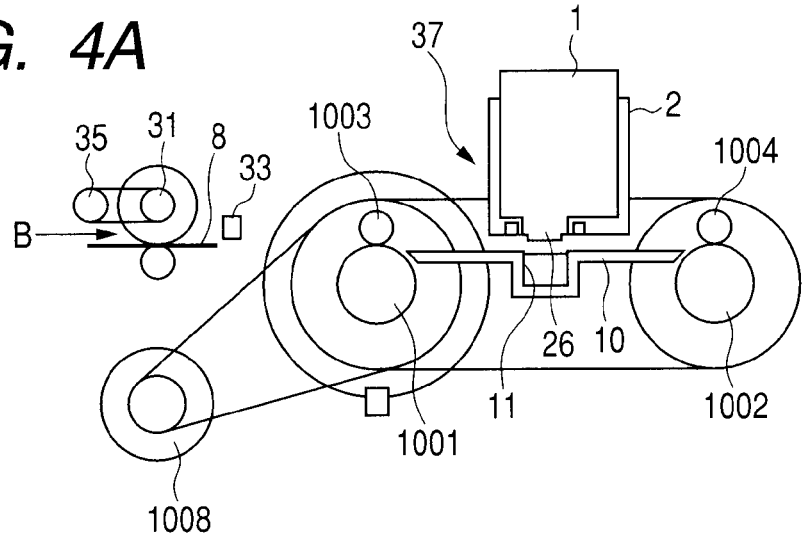
FIGS. 4A, 4B, and 4C are sectional views schematically illustrating the principal configuration of a conveying system.

As illustrated in FIGS. 1 and 4A, a first conveyance roller 1001, as a first conveyance member, and a pinch roller 1003, which is arranged to be pressed by the conveyance roller 1001 and is driven by the conveyance roller 1001, are provided on the upstream side of the printing unit 37 in the conveyance direction of the sheet 8. Moreover, a second conveyance roller 1002, as a second conveyance member, and a spur 1004, which is arranged to be opposed to the conveyance roller 1002 and is pressed and driven by the conveyance roller 1002, are provided on the downstream side of the printing unit 37 in the conveyance direction.

The conveyance roller 1001 is rotationally driven by the transmission of a rotary driving force by a carriage motor 1008, as a conveyance unit, through a gear. Timing belts may be used as the transmission mechanisms of the driving forces of the feed motor 35 and the carriage motor 1008. The second conveyance roller 1002 is also adapted to rotate and convey the sheet 8 as the first conveyance roller 1001 rotates. The driving force by the carriage motor 1008 is transmitted to the first conveyance roller 1001 and the second conveyance roller 1002 with a transmission gear train, and the first conveyance roller 1001 and the second conveyance roller 1002 severally convey the sheet 8 at almost the same speeds. Incidentally, the second conveyance roller 1002 may be adapted to be driven by a drive source different from that of the first conveyance roller 1001.

The nozzle array 29 of the head cartridge 1 mounted on the carriage 2 is held to be parallel to the sheet 8 between the two conveyance roller pairs. Furthermore, the sheet 8 is supported by a platen 10 by the back surface of the sheet 8 so as to form a flat surface to be printed in the printing unit 37. A plurality of ribs (not illustrated) is formed on the platen 10, and the sheet 8 is supported by the ribs. Then, when the sheet 8 passes the printing unit 37, the head cartridge 1 discharges ink to the sheet 8 on the basis of a predetermined image signal.

A groove 11 for enabling edgeless printing is formed in the platen 10, and an ink absorber 12 for receiving ink is held in the groove 11.

A paper sensor 33 capable of detecting the existence of the sheet 8 is arranged over the conveyance path of the sheet 8. At the time of feeding the sheet 8, the paper sensor 33 determines whether the feeding of the sheet 8 has been normally performed or not. Moreover, the timing at which the paper sensor 33 detects the front end of the sheet 8 is sometimes used also for deciding a printing starting position of the fed sheet 8. Furthermore, at the final stage of a printing operation, the paper sensor 33 is sometimes used also for deducing the position on the sheet 8 at which printing is performed now by grasping the position of the rear end in the subsequent printing operation by detecting the rear end of the sheet 8.

A direct sensor unit capable of directly detecting the movement of the sheet 8 is provided on the carriage 2. The direct sensor unit includes four image sensors 702, 703, 704, and 705 as imaging units. The image sensors 702, 703, 704, and 705 are provided at the four corners with the nozzle array 29 of the print head diagonally put therebetween. The image sensors 702, 703, 704, and 705 are provided at four positions on the upstream side and the downstream side of the groove 11 of the platen 10 put therebetween, and on the reference side a1 and the non-reference side a2 of the nozzle array 29. That is, the plurality of image sensors 702 to 705 are provided at a plurality of separated positions on the carriage 2, in the main scan direction and/or the sub-scan direction.

The image sensors 702, 703, 704, and 705 may be provided on the head cartridge 1 to be indirectly provided on the carriage 2 in place of being provided on the carriage 2. Moreover, the plurality of image sensors 702 to 705 may be provided at two positions at the upper stream on the non-reference side a2 and at the lower stream on the reference side a1, or may be provided at two positions at the upper stream on the reference side a1 and at the lower stream on the non-reference side a2. That is, the plurality of image sensors 702 to 705 has only to be provided at least at two positions on the carriage 2 with the nozzle array 29 diagonally put between the two positions. Moreover, a sensor array may be further added at another position.

The image sensors 702, 703, 704, and 705 severally radiate a detection light to the sheet 8, and severally obtain a reflected light from the surface of the sheet 8 as image information at a time different from each other. Then, the direct sensor unit detects the moving state (conveyance amount or conveyance speed) of the sheet 8 by comparing a part of the image information previously obtained by the image sensors 702, 703, 704 and 705 with the subsequently obtained image information by image correlation processing including pattern matching processing.

Figures 11A, 11B, 11C:
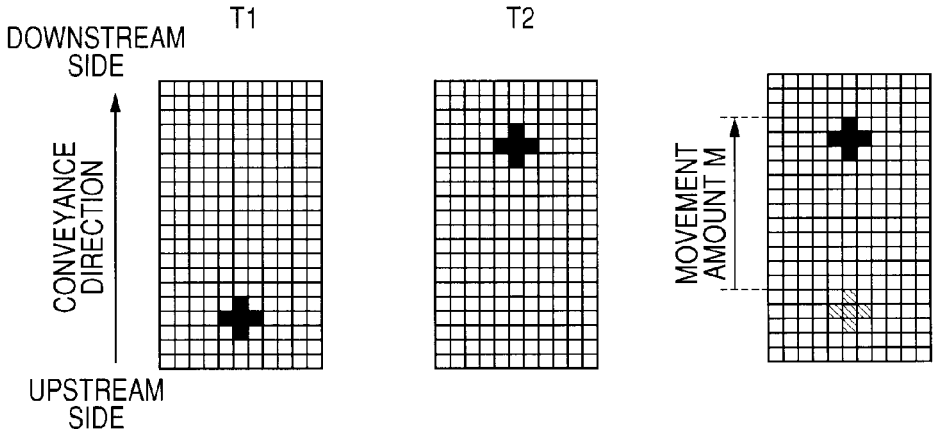
FIGS. 11A, 11B, and 11C are schematic diagrams for illustrating the concept of detecting a movement amount of a sheet on the basis of obtained image information.

FIGS. 11A to 11C are diagrams for describing the principle of direct sensing. An image 501 in FIG. 11A illustrates image data obtained by imaging using an image sensor at a time T1. FIG. 11B illustrates image data obtained by imaging when the sheet has slightly moved at a time T2 after the time T1. It is determined by signal processing including known pattern matching processing whether the same pattern as the pattern of a certain area in the image data of FIG. 11A (the pattern is a cross pattern here, but the pattern is actually arbitrary) exists in the image data of FIG. 11B or not. As a result of the determination, the movement amount M of the medium can be obtained on the basis of the shift amount (the number of pixels) between the patterns as illustrated in FIG. 11C. Furthermore, the movement speed of the sheet 8 during the movement can be obtained by dividing the movement amount M by the time of the difference between the times T1 and T2.

Figure 2:
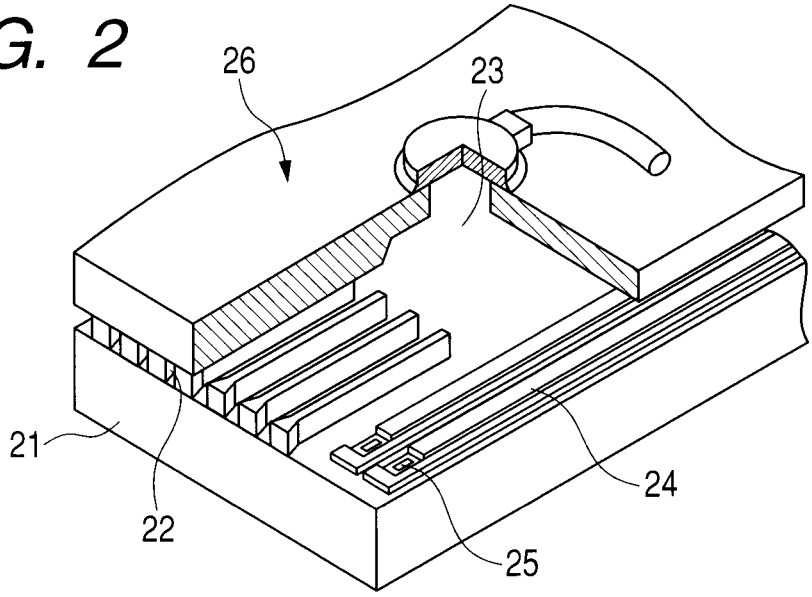
FIG. 2 is a perspective view illustrating the structure of a print head.

FIG. 2 is a perspective view schematically illustrating a part of the principal part of a print head 26 of the head cartridge 1 capable of being applied to the present embodiment.

As illustrated in FIG. 2, a plurality of nozzle arrays (nozzle arrays) 22 are formed at predetermined pitches on a discharge port surface 21 facing to the sheet 8 with a predetermined interval (about 0.5 mm to about 2.0 mm). Liquid paths 24 communicating with each of the nozzle arrays 22 from a common liquid chamber 23 are formed, and the ink existing in the common liquid chamber 23 is introduced to each discharge port by the capillary forces of the liquid paths 24. An electrothermal conversion element (heating resistor or the like) 25 for generating thermal energy is provided to be arranged on the wall surfaces of each of the liquid paths 24. A predetermined pulse is applied to the electrothermal conversion 25 on the basis of an image signal or a discharge signal, and the heat generated by the electrothermal conversion element 25 causes film boiling in the ink in the liquid path 24. Then, a predetermined amount of ink is discharged as a droplet from each of the nozzle arrays 22 by the foaming pressure at this time.

The present embodiment is a serial printing apparatus, and the nozzle arrays 22 are arranged in the direction intersecting (crossing at right angles) the scan direction of the carriage 2. Then, the main scan to discharge ink from each of the nozzle arrays 22 while the carriage 2 is moved to perform a scan and the sub-scan to convey the sheet 8 by a predetermined amount in the direction intersecting (crossing at right angles) the main scan direction are alternately repeated, and thereby an image is sequentially formed on the sheet 8.

Figure 3:
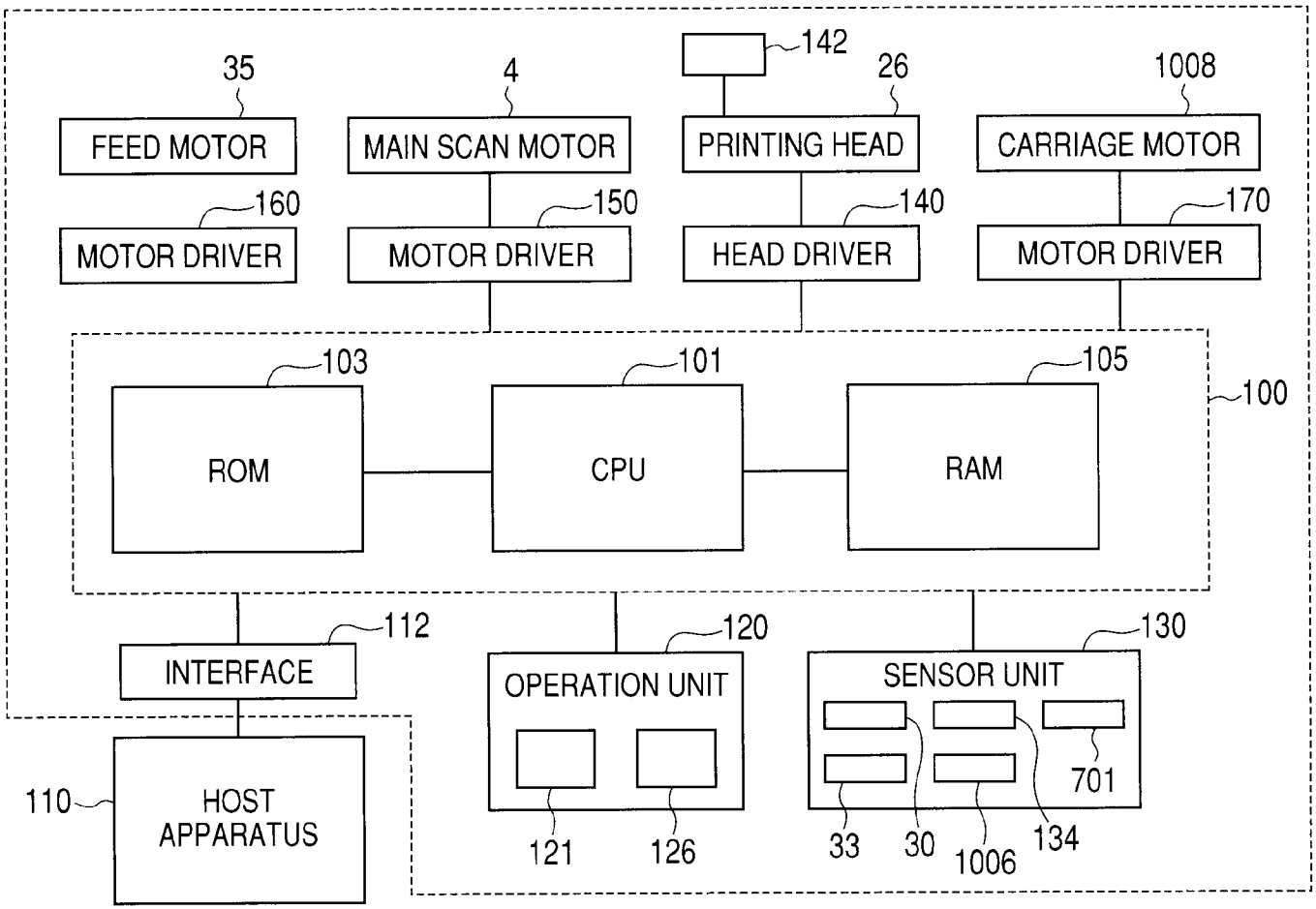
FIG. 3 is a block diagram for illustrating the configuration of a control unit.

FIG. 3 is a block diagram for describing the configuration of a control unit in the ink jet printing apparatus to be applied to the present embodiment.

As illustrated in FIG. 3, the control unit includes a controller 100, which is a main control unit as a control means of the ink jet printing apparatus. The controller 100 includes, for example, a central processing unit (CPU) 101, such as a microcomputer, a read only memory (ROM) 103 storing programs and necessary table and other fixed data, and a random access memory (RAM) 105 equipped with an area in which image data is expanded, an area for operations, and the like.

A host apparatus 110 is a unit that is connected to the outside of the ink jet printing apparatus and is a supply source of an image. The host apparatus 110 may be a computer that performs the creation, the processing, and the like of data of an image to be printed and the like, or may be in the form of a reader for reading an image. The control unit is adapted to be able to transmit and receive image data, the other commands, status signals, and the like, which are supplied from the host apparatus 110, to and from the controller 100 through an interface (I/F) 112.

An operation unit 120 is a switch group receiving an input instruction by an operator, and includes a power switch 121, a recovery switch 126 for instructing the starting of absorption recovery, and the like.

A sensor unit 130 is a sensor group for detecting the state of the printing apparatus. In the present embodiment, the sensor unit 130 includes a temperature sensor 134 provided for detecting an environmental temperature, a rotation angle image sensor 1006, a conveyance detection image sensor 701, and the like, besides the home position sensor 30 and the paper sensor 33 described above.

Moreover, the control unit includes a head driver 140, and drives the electrothermal conversion elements 25 of the print head 26 according to print data with the head driver 140. Moreover, the head driver 140 includes shift registers for aligning print data correspondingly to each of a plurality of electrothermal conversion elements 25, latch circuits for latching the print data at suitable timing, logic circuit elements for operating the electrothermal conversion elements 25 in synchronization with drive timing signals, and the like. Furthermore, the head driver 140 includes a timing setting unit for setting a discharge timing suitably in order to adjust dot forming positions on the sheet 8.

A sub-heater 142 is provided in the neighborhood of the print head 26. The sub-heater 142 performs the temperature adjustment of the print head 26 in order to stabilize the discharge characteristic of ink. The sub-heater 142 may take a form formed on the substrate of the print head 26 similarly to the formation of the electrothermal conversion elements 25, or may take a form attached to the main body of the print head 26 or the head cartridge 1.

Moreover, the control unit includes a motor driver 150 for driving the main scan motor 4, and a motor driver 170 for driving the carriage motor 1008. By the driving of the main scan motor 4, the carriage 2 is moved in the main scan direction. By the driving of the carriage motor 1008, the sheet 8 is conveyed in the sub-scan direction.

Moreover, the control unit includes a motor driver 160 for driving the feed motor 35. By the driving of the feed motor 35, the sheet 8 is separated from the auto sheet feeder 32, and is fed into the ink jet printing apparatus.

First Embodiment

Figure 4B:
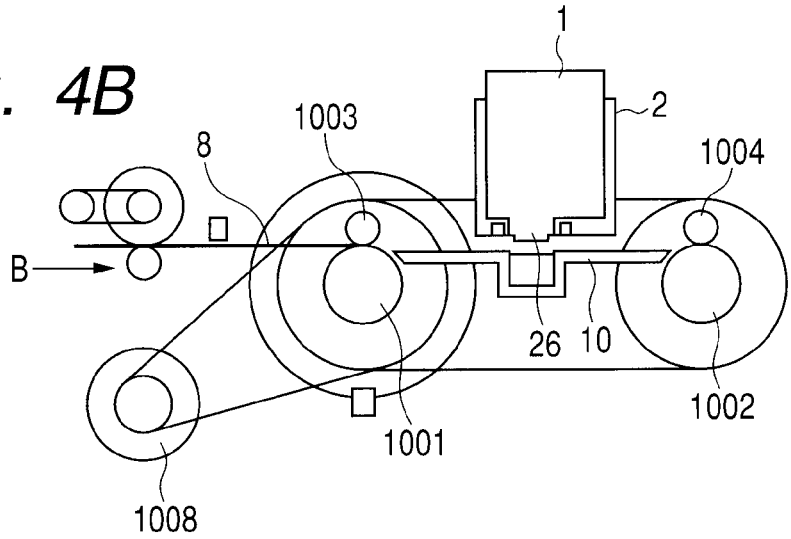
Figure 4C:
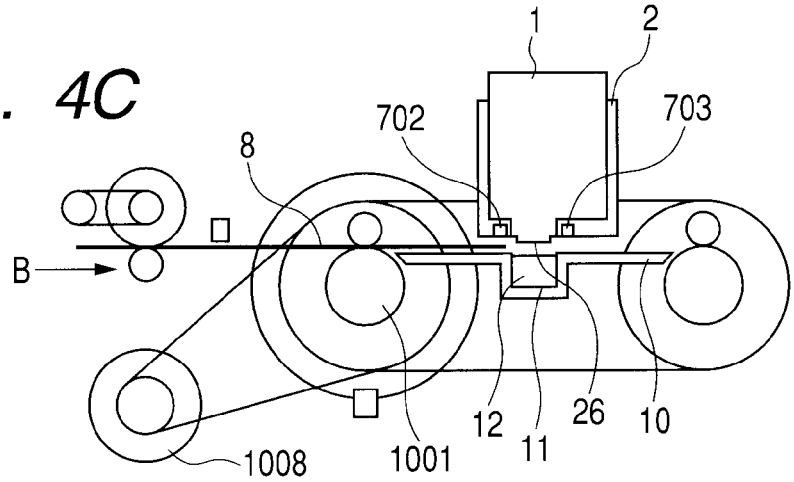

FIGS. 4A to 4C are views for describing the conveyance state of the sheet 8 at each timing of the present embodiment.

As illustrated in FIG. 4A, when a printing operation is started, the paper feeding of the sheet 8 is first started. The sheet 8 is conveyed in the direction of the arrow B illustrated in FIG. 4A by the driving of the pickup roller 31 by the driving of the feed motor 35.

Next, it is judged whether the paper sensor 33 detects the front end of the sheet 8 or not. The feed motor 35 continues to drive the pickup roller 31 to perform the paper feeding operation until the front end is detected.

When the front end of the sheet 8 is detected by the paper sensor 33, the sheet 8 is conveyed by a predetermined amount, and the front end of the sheet 8 abuts against a nipped area (the area where the sheet 8 is nipped) between the conveyance roller 1001 and the pinch roller 1003 driven by the conveyance roller 1001. Thereby, registration for correcting the oblique running of the sheet 8 is performed. This stage corresponds to the state illustrated in FIG. 4B.

After the registration, the main scan motor 4 is driven, and thereby the carriage 2 moves to a position where the end of the sheet 8 on the reference side a1 in the width direction of the sheet 8 is opposed to the image sensor 702. Thereby, the detection of the sheet 8 is made to be enabled by the conveyance of the front end of the sheet 8 to the position of the image sensor 702.

Figure 5:
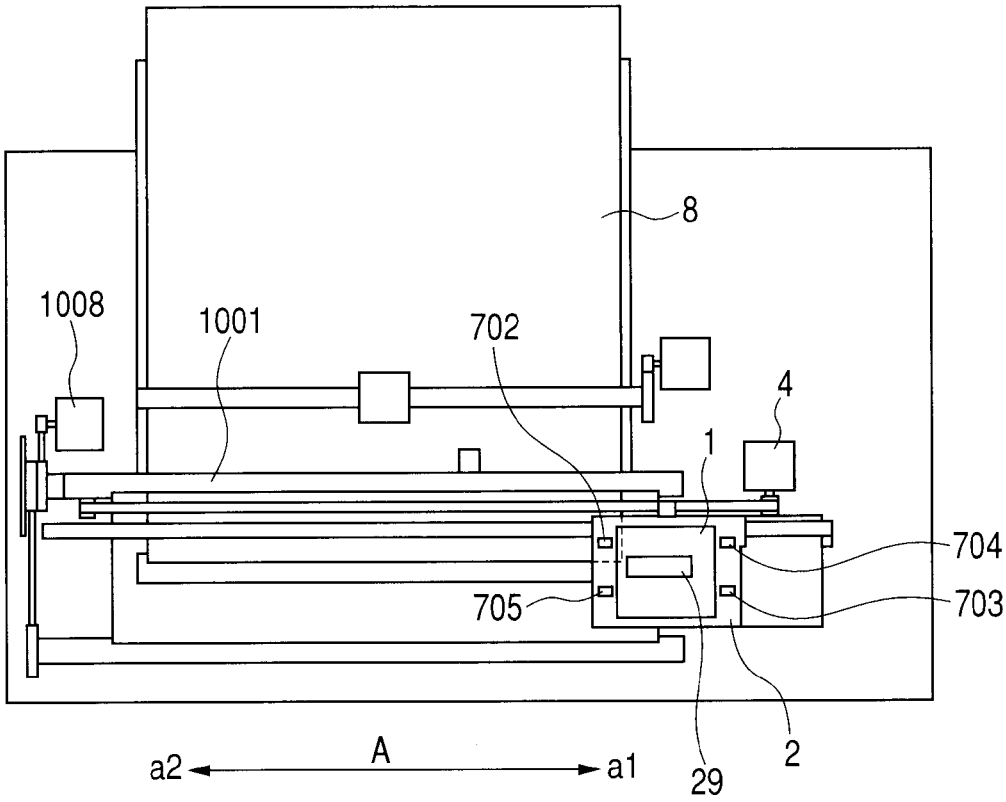
FIG. 5 is a plan view for illustrating the principal configuration of the conveying system.

After that, the carriage motor 1008 is driven to rotate the conveyance roller 1001, and thereby the sheet 8 is conveyed until the front end thereof is detected by the image sensor 702 on the carriage 2. When the front end of the sheet 8 is detected by the image sensor 702, a printing operation is enabled to be started. This stage corresponds to the state illustrated in FIGS. 4C and 5. In the following, the case of performing edgeless printing will be described as an example.

When the front end of the sheet 8 is detected by the image sensor 702, the main scan motor 4 is driven by the controller 100 of the control unit, and thereby the carriage 2 is moved from the reference side a1 toward the non-reference side a2.

When the carriage 2 is moved, the head driver 140 is driven to discharge ink from the nozzle array 29, and an image is formed on the sheet 8.

Figure 6:
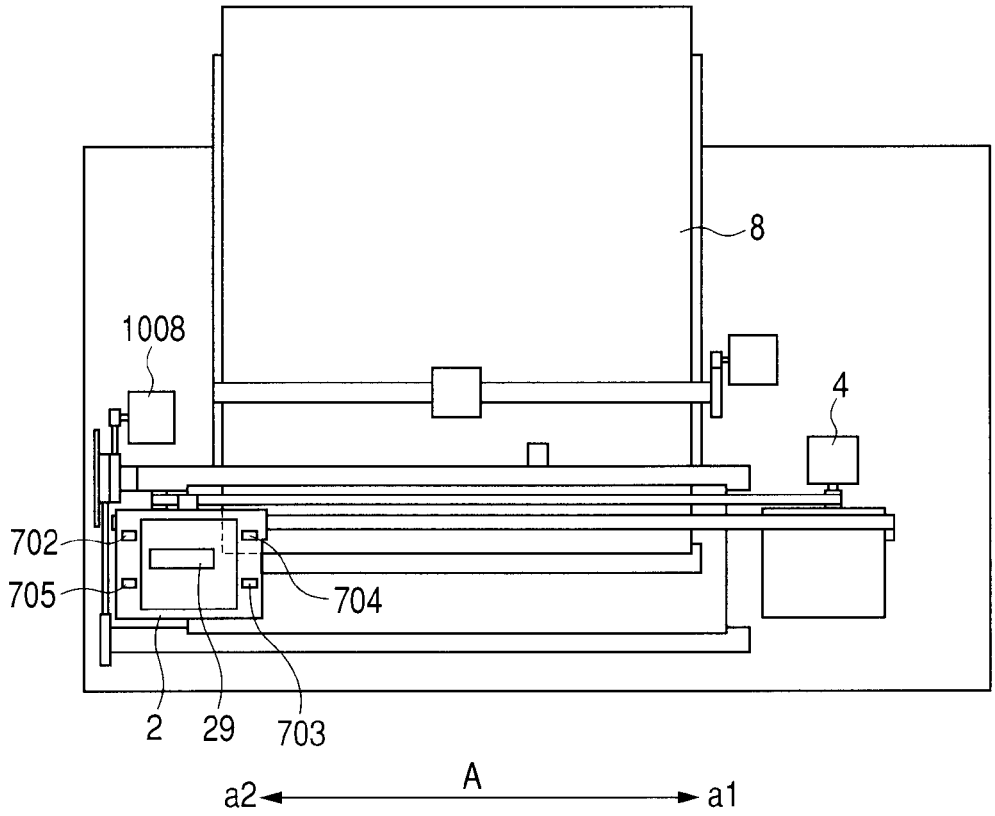
FIG. 6 is a plan view illustrating a state in which a carriage has moved to a non-reference side.
Figure 7:
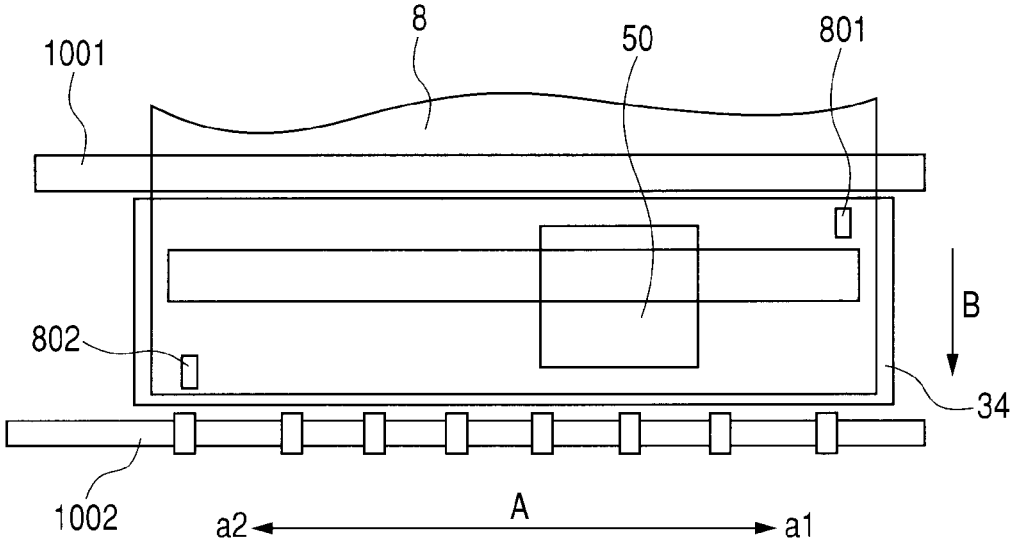
FIG. 7 is a plan view illustrating an arrangement of an image sensor of a second embodiment.

Successively, the carriage 2 is moved to the non-reference side a2, and then, when the carriage 2 is moved from the non-reference side a2 toward the reference side a1 (at the time of reversing) the image sensor 704 is opposed to the end of the sheet 8 on the non-reference side a2 in the width direction of the sheet 8, as illustrated in FIG. 6. When the sheet 8 is conveyed by driving the carriage motor 1008, it becomes possible to read the moving state (conveyance amount and conveyance speed) of the sheet 8 with the image sensor 704. Moreover, even at the time just before a reverse operation of the carriage 2, it is possible to read the moving state of the sheet 8 as long as the image sensor 704 and the sheet 8 are opposed to each other. Consequently, the drive amount of the carriage motor 1008 becomes highly accurate by the driving of the carriage motor 1008 by the controller 100 on the basis of the detection results of the image sensor 704. Thus, the simultaneous driving of the main scan motor 4 and the carriage motor 1008 can be performed, and printing time can be shortened.

After the conveyance of the sheet 8, or during the conveyance of the sheet 8, the main scan motor 4 is driven to move the carriage 2 from the non-reference side a2 toward the reference side a1, and the head driver 140 is driven to discharge ink from the nozzle array 29 when the carriage 2 is moved. Then, an image is formed on the sheet 8. Also on the reference side a1, similarly to on the non-reference side a2, the moving state of the sheet 8 driven by the carriage motor 1008 can be read with the image sensor 702 at the time of the reversing of the carriage 2, or just before the reversing of the carriage 2. By the operations, bidirectional printing in the main scan direction can be performed.

The above series of operations is continued to be repeated. Then, before the rear end of the sheet 8 passes the image sensor 702 or 704, the state of the printing apparatus is switched to the state in which the rear end is detected by the image sensors 703 and 705 on the downstream side. By the switching from the sensors 702 and 704 on the upstream side to the sensors 703 and 705 on the downstream side, the "sensing disabled period" on the rear end of the sheet 8 is removed. Thus, the direct sensor unit can directly detect the moving state of the sheet 8 in the whole print area thereof in the main scan direction and the sub-scan direction, and can convey the sheet 8. Then, the sheet 8 can be conveyed at high accuracy, and the quality of a printed image is improved.

After the printing of the whole area of the sheet 8 has ended, the carriage motor 1008 is driven, and thereby the sheet 8 is ejected from the print area. Then the printing operation of the sheet 8 ends.

According to the present embodiment, because the non-detection region of the sheet 8 by the image sensors 702, 703, 704, and 705 is removed, the conveyance amount or the conveyance speed of the sheet 8 can be detected at high accuracy, and the sheet 8 can be conveyed at high accuracy. Consequently, according to the present embodiment, the improvement of printing quality can be attained.

Incidentally, although the configuration example of including four image sensors 702 to 705 has been described above, the present invention is not limited to this configuration. As described above, the image sensors 702 to 705 have only to be provided at two positions on the upstream side of the non-reference side a2 and on the downstream side of the reference side a1, or at two positions on the upstream side of the reference side a1 and on the downstream side of the non-reference side a2, that is, at least at two positions on the carriage 2 with the recording element array diagonally put between the two positions. In other words, the image sensors have only to be provided at least at two separated positions on the carriage 2 with the recording element array put between the positions in both the main scan direction and the sub-scan direction. If imaging is performed at least at these two positions, then the direct sensing over the whole surface of the sheet 8 can be performed in both of the main scan direction and the sub-scan direction. That is, the detection in a wide range covering the sheet width of the maximum size can be performed in the main scan direction, and the "sensing disabled period" is removed in the sub-scan direction.

In the following, the configuration of including two image sensors in total: one on the upstream side of the non-reference side a2, and one on the downstream side of the reference side a1, will be described.

The differences between the configuration of including two image sensors and the aforesaid configuration of including four image sensors will be chiefly described. If edgeless printing is performed, the print area is larger than the width of the sheet 8. For this reason, when the carriage 2 moves from the reference side a1 to the non-reference side a2 while an image is formed by the print head 26 in the case where the printing is performed at the front end of the sheet 8, the image sensor deviates from the area of the sheet 8. Because the image sensor cannot read the movement amount of the sheet 8 if the state remains as it is, the main scan motor 4 is driven to move the carriage 2 toward the reference side also as to move the image sensor to the end of the sheet 8 on the non-reference side a2 in the width direction of the sheet 8. After moving the carriage 2, the moving state of the sheet is directly detected by the image sensors, and the controller 100 drives the carriage motor 1008 on the basis of the detected value to convey the sheet 8. After the conveyance of the sheet 8, the main scan motor 4 is driven to move the carriage 2 to the outside of the area of the sheet 8 on the non-reference side a2 again. Then, the main scan motor 4 is driven to move the carriage 2 from the non-reference side a2 toward the reference side a1, and the head driver 140 is driven at the time of moving the carriage 2 to discharge ink from the nozzle array 29. Thus, an image is formed on the sheet 8.

Because the sheet 8 and one of the image sensors are opposed to each other on the reference side a1, the moving state of the sheet 8 can be detected at the stop position of the carriage 2.

When the front end of the sheet 8 arrives at the image sensor on the downstream side, the moving state of the sheet 8 on the non-reference side a2 can be detected by the image sensor arranged on the downstream side of the reference side a1. Moreover, because the moving state of the sheet 8 on the reference side a1 can be detected by the image sensor arranged on the upstream side of the non-reference side a2, it is unnecessary to move the carriage 2 for the objects other than the object of image formation.

After the rear end of the sheet 8 has deviated from the image sensor on the upstream side, an operation similar to that of the carriage 2 other than the printing operation of the front end of the sheet 8 on the non-reference side a2 is performed on the reference side a1. That is, the main scan motor 4 is driven to move the carriage 2 to the non-reference side also that the image sensor on the reference side a1 may be situated at the end of the sheet 8 on the reference side a1 in the width direction of the sheet 8. After the movement of the carriage 2, the image sensor directly detects the moving state of the sheet 8, and the controller 100 drives the carriage motor 1008 on the basis of the detected value to convey the sheet 8. After the conveyance of the sheet 8, the main scan motor 4 is driven to move the carriage 2 to the outside of the area of the sheet 8 on the reference side a1 again. Then, the main scan motor 4 is driven to move the carriage 2 from the reference side a1 toward the non-reference side a2, and the head driver 140 is driven to discharge ink from the nozzle array 29 when the carriage 2 is moved. Thus, an image is formed on the sheet 8.

Because the end of the sheet 8 on the non-reference side a2 in the width direction of the sheet 8 is opposed to the image sensor on the non-reference side a2, the moving state of the sheet 8 can be detected at the stop position of the carriage 2.

As described above, because it is necessary to move the carriage 2 for the object other than the object of image formation, the time necessary for the image formation becomes longer in comparison with that of the configuration of including the four image sensors 72 to 75. However, because the present embodiment can reduce the number of image sensors to be used, the manufacturing cost thereof can be reduced.

Second Embodiment

The present embodiment is an embodiment provided with image sensors on a platen in place of the carriage 2. As illustrated in FIG. 7 and FIGS. 8A to 8D, a first image sensor 801 and a second image sensor 802 constituting a direct sensor unit are provided on a platen 34.

The first and the second image sensors 801 and 802 are arranged in aperture portions formed in the platen 34, and are placed at positions opposed to the back surface of the sheet 8 in positional relations enabling the image sensors 801 and 802 to be seen from the upper side of the aperture portions. The first and the second image sensors 801 and 802 are provided at the positions opposed to the nozzle array 29 of the print head 26, and are adapted to detect the sheet 8 from the opposite side of the print head 26 with the sheet 8 put between them.

Moreover, the first image sensor 801 is placed in the neighborhood of the first conveyance roller 1001 (first roller) on the downstream side in the conveyance direction and on the inside of the end of the sheet 8 on the reference side a1 in the width direction of the sheet 8. The second image sensor 802 is placed in the neighborhood of the second conveyance roller 1002 (second roller) on the upstream side in the conveyance direction and on the inside of the end of the sheet 8 on the non-reference side a2 in the width direction of the sheet 8. That is, the plurality of image sensors 801 and 802 is provided at positions on the platen 34 corresponding to at least two positions diagonally putting the movement locus of the recording element array of the print head 26 between the two positions. Then, the plurality of image sensor 801 and 802 can image the sheet 8 at least at two positions separated in the main scan direction and the sub-scan direction. Such arrangements of the first and the second image sensors 801 and 802 enable the movement amount to be directly detected in the whole area of the sheet 8. The controller 100 performs the feedback control of the carriage motor 1008 on the basis of the detection results (output information) to realize the stopping of the sheet 8 at high accuracy, and realizes the high image quality printing by the use of the print head 26. Incidentally, the control unit may perform the feedback control to change the recording timing of image formation in place of controlling the carriage motor 1008 of a conveying mechanism on the basis of the detection of the direct sensor unit. That is, if the control unit controls at least either of the conveying mechanism and the printing unit 37 so as to reduce the influences exerted on the image to be recorded by the conveyance accuracy of the conveying mechanism on the basis of the detection of the direct sensor unit, then high quality image formation can be realized as a result.

Figure 8A:
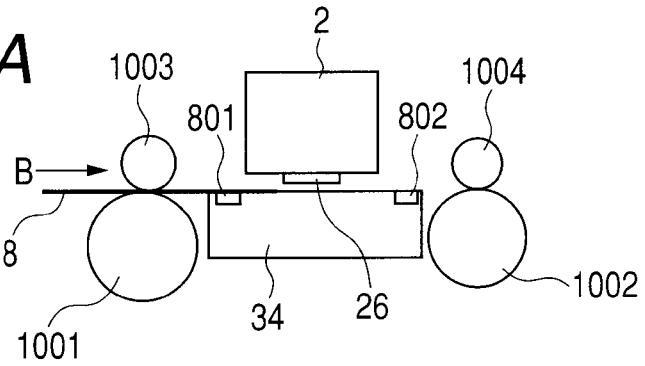
FIGS. 8A, 8B, 8C, and 8D are sectional views for illustrating the operation of reading the moving state of a sheet.

FIGS. 8A, 8B, 8C, and 8D illustrate an operation at the time of reading the moving state of the sheet 8. As illustrated in FIG. 8A, when the sheet 8 arrives at the first image sensor 801, the conveyance amount of the sheet 8 is detected. In this state, the controller 100 performs the feedback control of the carriage motor 1008 on the basis of the detection result (output information) of the first image sensor 801.

Figure 8B:
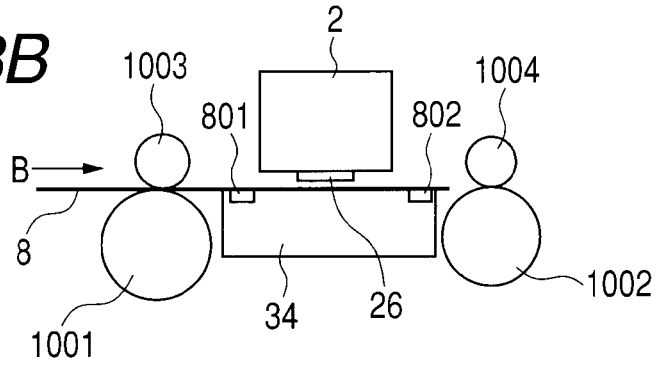

As illustrated in FIG. 8B, when the sheet 8 arrives at the second image sensor 802, the conveyance amount of the sheet 8 is detected by the use of the two sensors of the first image sensor 801 and the second image sensor 802. The respective conveyance amounts on both the sides of the sheet 8 in the width direction thereof do not agree with each other owing to the difference between the conveyance resistance on both the sides, and a difference arises. In particular, in the case of using a sheet having the size of A4 or more, printing is performed in the state in which the rear end of the sheet 8 having the comparatively long length in the conveyance direction thereof remains in the path of a paper feeding unit. For this reason, the difference between the conveyance resistance on both the sides of the sheet 8 in the width direction thereof is easily caused according to the path shape of the ASF 32 or a U turn during the printing from the front end of the sheet 8 to the middle thereof. Consequently, phenomena, such as the occurrence of a white stripe, a black stripe, or image unevenness only on one side of a printed sheet 8 in the width direction thereof, sometimes arise.

In the present embodiment, the conveyance amounts on both the sides of the sheet 8 in the width direction thereof are detected at the same time by the use of the two sensors of the first image sensor 801 and the second image sensor 802, and the conveyance amount of the sheet 8 is controlled on the basis of the average value of the detected conveyance amounts. Thereby, the printing apparatus that suppresses the occurrence of the phenomena described above on the both the sides of the sheet 8 in the width direction thereof can be realized. Moreover, the conveyance amounts of the sheet 8 on both the sides in the width direction thereof are detected, and the inclination amount of the sheet 8 to the original conveyance direction is judged. Then, the image formation with the corrected inclination amounts is performed, and thereby printing can be performed in further higher image quality.

Figure 8C:
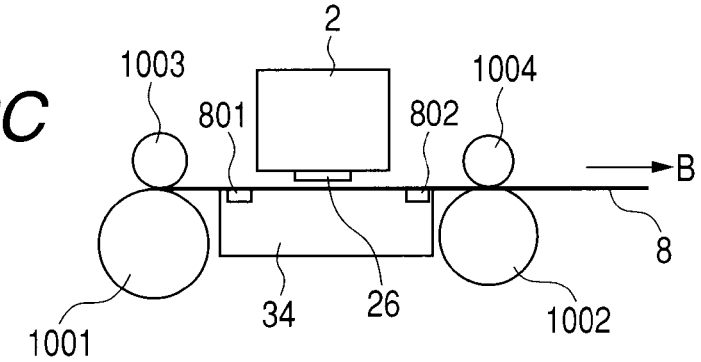

As illustrated in FIG. 8C, the sheet 8 exits from the nipped area between the first conveyance roller 1002 and the pinch roller 1003, and becomes the state of being conveyed to be put between the second conveyance roller 1002 and the spur 1004 to be put between them. In this state, the variations of the conveyance amount are large when the sheet 8 exits from the nipped area between the first conveyance roller 1001 and the pinch roller 1003, from which large pressing force is applied to the sheet 8. Accordingly, the present embodiment uses the two sensors of the first image sensor 801 and the second image sensor 802 to severally directly detect the conveyance amount of the sheet 8 continuously at the timing when the sheet 8 passes through the nipped area (just after the passage of the sheet 8). Then, the controller 100 performs the feedback control of the carriage motor 1008 on the basis of each of the detection results (detection information) of the first and the second image sensors 801 and 802. As described above, the control unit may perform the feedback control so as to change the recording timing of image information, in place of performing the feedback control of the carriage motor 1008 of the conveying mechanism, on the basis of the detection in the direct sensor unit. Thus, the influences of the changes of the behavior of the sheet 8 caused at the time of the exiting of the sheet 8 from the nipped area can be suppressed to be small. Moreover, it is also possible to judge the inclination amount of the sheet 8 in the conveyance direction to perform the image formation with the corrected inclination amount similarly to that described above.

Figure 8D:
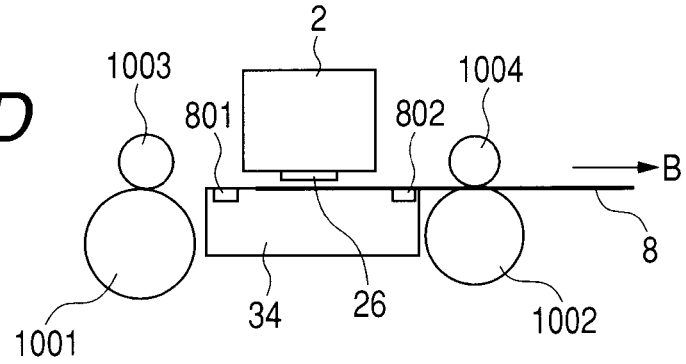

After that, when the rear end of the sheet 8 passes through the first image sensor 801 as illustrated in FIG. 8D, the sheet 8 becomes the state in which the second image sensor 802 directly detects the conveyance amount of the sheet 8. In this state, the controller 100 performs the feedback control of the carriage motor 1008 on the basis of the detection result (output information) of the second image sensor 802. Because the conveyance amount of the sheet 8 can be directly controlled by the second image sensor 802, the stabilization of the printed image at the rear end of the sheet 8 can be attained. By this switching from the sensor 801 on the upstream side to the sensor 802 on the downstream side, the "sensing disabled period" at the rear end of the sheet 8 is removed.

As described above, according to the present embodiment, the direct detection of the movement amount of the sheet 8 can be performed in the whole area of the sheet 8 in the conveyance direction thereof from the front end thereof to the rear end thereof at the time of a printing operation. For this reason, the present embodiment can realize a printing apparatus capable of conveying the sheet at high accuracy and performing high image quality printing. Moreover, because the present embodiment can measure the conveyance amounts of the sheet 8 on the reference side a1 and the non-reference side a2, the present embodiment can numerically calculate the difference between the conveyance amounts on both the sides of the sheet 8 in the width direction thereof. Moreover, the present embodiment can obtain the conveyance amount of the sheet 8 at almost the center of the width direction of the sheet 8 by averaging the difference of the conveyance amounts on both the sides of the sheet 8 in the width direction thereof. For this reason, the present embodiment can improve the reliability of the conveyance amount of the sheet 8 in comparison with that of the case of measuring only the conveyance amount of the sheet 8 on one end thereof. Furthermore, if the difference between the conveyance amounts of the sheet 8 on both the sides thereof in the width direction thereof is larger than a predetermined value, then further higher quality printing can be performed by performing the image formation with a corrected inclination amount in the conveyance direction of the sheet 8.

Third Embodiment

Further another embodiment will be described with reference to FIG. 9 and FIGS. 10A to 10D. The same members as those of the embodiments described above are denoted by the same marks as those of the embodiments described above.

Figure 9:
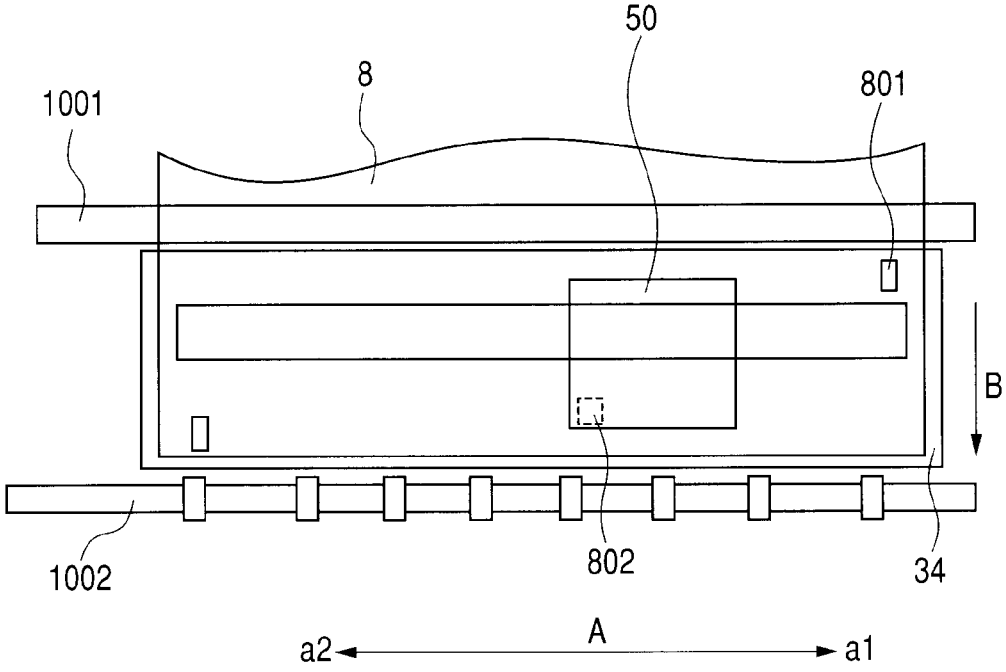
FIG. 9 is a plan view illustrating the arrangement of an image sensor in a third embodiment.

As illustrated in FIG. 9, the first image sensor 801 is provided on the platen 34. The second image sensor 802 is provided on a carriage 50 at a position opposed to the surface to be printed of the sheet 8 on the downstream side of the nozzle array 29 of the print head 26. The present embodiment includes the first image sensor 801 provided on the platen 34 on the side of one end of a moving stroke (reference side or non-reference side) and the second image sensor 802 provided on the carriage 50 at a position near to the side different from that of the aforesaid one end (non-reference side or reference side). Then the first image sensor 801 and the second image sensor 802 are in a separated positional relation in the sub-scan direction. That is, the plurality of image sensors 801 and 802 are arranged so as to be able to image the sheet 8 at least at two positions in the main scan direction and in the sub-scan direction.

Incidentally, the second image sensor 802 may be indirectly provided on the carriage 50 by being formed on the head cartridge 1.

Figure 10A:
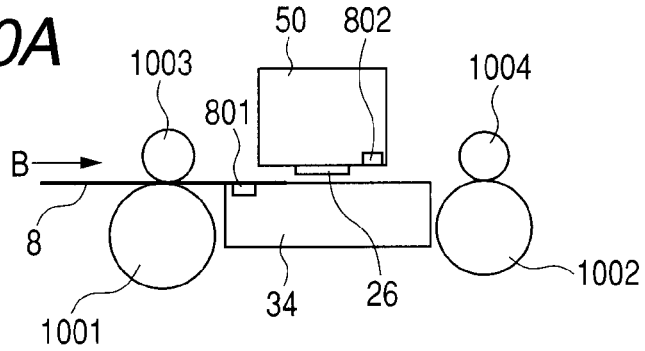
FIGS. 10A, 10B, 10C, and 10D are sectional views for illustrating the operation of reading the moving state of a sheet.

FIGS. 10A to 10D illustrate an operation at the time of reading the moving state of the sheet 8. As illustrated in FIG. 10A, when the sheet 8 arrives at the first image sensor 801, the moving state of the sheet 8 is detected. The controller 100 performs the feedback control of the carriage motor 1008 on the basis of the detection result (output information) of the first image sensor 801. As described above, the control unit may perform the feedback control so as to change the recording timing of the image formation, in place of performing the feedback control of the carriage motor 1008 of the conveying mechanism, on the basis of the detection of the direct sensor unit.

Figure 10B:
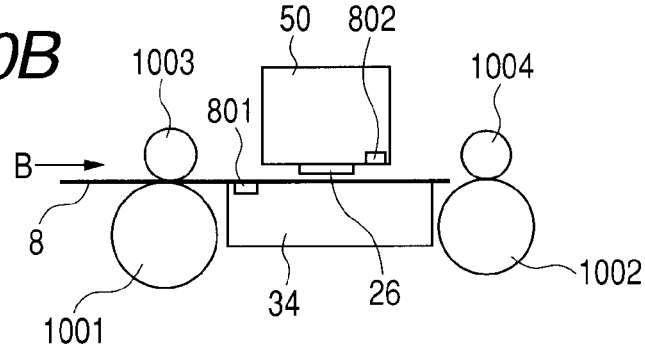

As illustrated in FIG. 10B, when the front end of the sheet 8 arrives at a position under the second image sensor 802 on the carriage 50, the carriage 50 moves toward the side of the non-reference side a2 while a printing operation is performed. Then, while the sheet 8 is conveyed, the second image sensor 802 detects the moving state (conveyance amount) of the sheet 8. At the same time, also the first image sensor 801 detects the moving state of the sheet 8. After that, while actual printing is being performed, the carriage 50 moves toward the reference side a1.

In this manner, the two sensors of the first image sensor 801 and the second image sensor 802 severally detect each of the conveyance amounts on both the sides of the sheet 8 in the width direction thereof, and the controller 100 controls the conveyance amount of the sheet on the basis of the average value of the conveyance amounts.

Figure 10C:
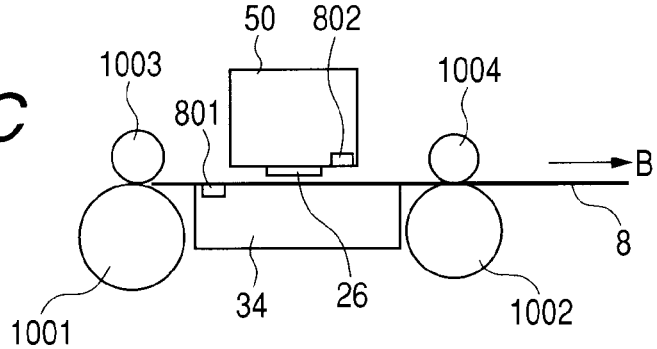

As illustrated in FIG. 10C, the sheet 8 exits from the nipped area between the first conveyance roller 1001 and the pinch roller 1003, and the sheet 8 becomes the state of being conveyed to be put between the second conveyance roller 1002 and the spur 1004. In this state, the conveyance amounts of the sheet 8 are continuously and directly detected by the two sensors of the first image sensor 801 and the second image sensor 802 at the timing when the sheet 8 exits from the nipped area. Then, the controller 100 performs the feedback control of the carriage motor 1008 on the basis of these detection results (output information).

Thereby it is also possible to suppress the influences of the changes of the behavior of the sheet 8 caused when the sheet 8 exits from the nipped area to be small. Moreover, similarly to the above, the inclination amount of the sheet 8 to the conveyance direction thereof is judged, and the image formation is performed with the corrected inclination amount. Thereby the printing apparatus capable of performing further high image quality printing can be provided.

Figure 10D:
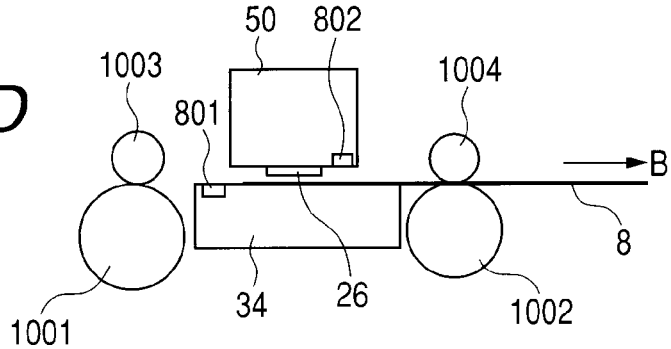

After that, as illustrated in FIG. 10D, when the rear end of the sheet 8 has passed through the first image sensor 801, the sheet 8 becomes the state in which the conveyance amount thereof is directly detected by the second image sensor 802. In this state, the controller 100 performs the feedback control of the carriage motor 1008 on the basis of the detection results of the second image sensor 802. Because the conveyance amount of the sheet 8 can be directly controlled with the second image sensor 802, the accuracy of the image formation at the rear end of the sheet 8 is heightened.

According to the present embodiment, the provision of the second image sensor 802 on the carriage 50 enables the detection of conveyance amounts not only at specific positions of the carriage 50 in the main scan direction, but also at an arbitrary position.

Moreover, although a specific paper size is exemplified to be described in the present embodiment, the configuration of setting the measurement position of the conveyance amount on the non-reference side a2 of the carriage 50 (or the measurement position of the conveyance amount on the reference side a1) according to the information of the paper size specified by a user to perform the detection operation may be adopted. Thereby, various paper sizes can be dealt with. Moreover, with regard to the setting position of the sheet 8, the present embodiment is not limited to the paper feeding mechanism of setting all of the sheets 8 by the right end reference or the left end reference of the sheets 8 in the width direction thereof. For example, it is possible to deal with the measurements of the conveyance amounts according to various paper sizes without increasing the image sensors even in the paper feeding mechanism in which the sheet 8 is set at almost the center of the auto sheet feeder 32 to differentiate the reference position of starting writing to every paper size of the sheet 8.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-307720, filed Dec. 2, 2008, which is hereby incorporated by reference herein in its entirety.

What is claimed is:

1. A printing apparatus, comprising:

a conveying unit which moves a sheet in a first direction;

a printing unit which performs printing on the sheet, the printing unit comprising a print head in which a recording element array is formed and a carriage which reciprocates along a second direction intersecting the first direction; and a direct sensor unit comprising a plurality of image sensors configured to image the sheet, the direct sensor unit is configured to perform signal processing of outputs of the plurality of image sensors to detect a movement of the sheet, wherein the plurality of image sensors are provided on the carriage in at least two positions, such that a line connecting the two positions is in a third direction intersecting the first direction and the second direction, and wherein at least the recording element array is disposed between the two positions.

2. The printing apparatus according to claim 1, further comprising:

a control unit configured to control either of the conveying unit and the printing unit based on the detection by the direct sensor unit.

3. The printing apparatus according to claim 1, wherein image sensors, of the plurality of image sensors, which are to be used to image the sheet are switched to other image sensors, of the plurality of image sensors, as the carriage moves.

4. The printing apparatus according to claim 3, wherein the image sensors, of the plurality of image sensors, which are to be used to image the sheet are switched to the other image sensors, of the plurality of image sensors, as the conveying unit conveys the sheet.

5. The printing apparatus according to claim 1, wherein image sensors, of the plurality of image sensors, which are to be used to image the sheet are switched to other image sensors, of the plurality of image sensors, as the conveying unit conveys the sheet.

6. The printing apparatus according to claim 1, wherein the conveying unit includes a platen for supporting the sheet, a first roller, and a second roller, wherein the first roller and the second roller are arranged such that the platen is disposed between them in the first direction.

7. A printing apparatus, comprising:

a conveying unit comprising a platen for supporting a sheet, a first roller, and a second roller, wherein the first and second roller are arranged such that the platen is disposed between them in a first direction, and the conveying unit is configured to move the sheet in the first direction;

a printing unit which performs printing on the sheet, the printing unit comprising a print head in which a recording element array is formed and a carriage disposed between the first roller and the second roller, and which reciprocates along a second direction intersecting the first direction; and a direct sensor unit comprising a plurality of image sensors configured to image the sheet, the direct sensor unit is configured to perform signal processing of outputs of the plurality of image sensors to detect a movement of the sheet, wherein the plurality of image sensors are provided at two or more positions on the platen, such that a line connecting the two positions is in a third direction intersecting the first and the second direction, and wherein a movement locus of the recording element array is in between the two or more positions.

8. A printing apparatus, comprising:

a conveying unit comprising a platen for supporting a sheet, a first roller, and a second roller, wherein the first roller and the second roller are arranged such that the platen is disposed between them in a first direction, and the conveying unit is configured to move the sheet in the first direction;

a printing unit which performs printing on the sheet, the printing unit comprising a print head in which a recording element array is formed and a carriage disposed between the first roller and the second roller, and which reciprocates along a second direction intersecting the first direction;

a plurality of images sensors configured to image the sheet; and a direct sensor unit configured to perform signal processing of outputs of the plurality of image sensors to detect a movement of the sheet, wherein the plurality of image sensors include a first image sensor provided on the platen on a side of one end of a moving stroke of the carriage and a second image sensor provided on the carriage near a distal side of the carriage with respect to the one end, and wherein the first image sensor and the second image sensor are separated positionally in the first direction.

* * * * *